United States Patent [19]

Neri et al.

[11] 4,406,251

[45] Sep. 27, 1983

[54] DEVICE FOR FEEDING SHEETS TO PACKAGING MACHINES

[75] Inventors: Bruno Neri; Renato Manservisi, both of Bologna, Italy

[73] Assignee: Sasib S.p.A., Bologna, Italy

[21] Appl. No.: 251,737

[22] Filed: Apr. 7, 1981

[30] Foreign Application Priority Data

Apr. 9, 1980 [IT] Italy ..... 12506 A/80

[51] Int. Cl.[3] ..... B05C 1/02; B05C 13/00

[52] U.S. Cl. ..... 118/704; 118/41; 118/236; 118/235; 118/212; 83/236

[58] Field of Search ..... 53/203; 318/625, 685; 83/209, 236; 118/696, 697, 674, 704, 40, 41, 42, 235, 236, 212, 248

[56] References Cited

U.S. PATENT DOCUMENTS

| | | | |
|---|---|---|---|
| 2,396,417 | 3/1946 | Gerlach | 118/42 |
| 3,121,018 | 2/1964 | Wood et al. | 118/40 |
| 3,177,749 | 4/1965 | Best et al. | 83/208 |
| 3,599,521 | 8/1971 | Lee | 83/210 |
| 3,757,619 | 9/1973 | Gianese | 83/65 |
| 4,006,395 | 2/1977 | Reesen | 318/625 |
| 4,277,731 | 7/1981 | Pongracz | 53/203 |

*Primary Examiner*—John P. McIntosh

*Attorney, Agent, or Firm*—Spencer & Kaye

[57] ABSTRACT

A device for feeding sheets of wrapping material from a roll formed of wrapping material web to a packaging machine which discontinuously operates at consecutive cycles. The device includes a transversal cutter provided with cutter blades for cutting single sheets of wrapping material from the web which has a new leading edge after each cut, and at least one intermittent motion feeding group for feeding the web to the cutter. A first independent electric stepping motor drives the feeding group and is controlled by a programmable electronic control circuit which controls the stepping motor to drive the feeding group in accordance with a predetermined sequence of motions in synchronism with the cycles the packaging machine, including momentarily driving the feeding group backwards to withdraw and detach the leading edge of the web from the cutter blades.

24 Claims, 6 Drawing Figures

Fig. 4
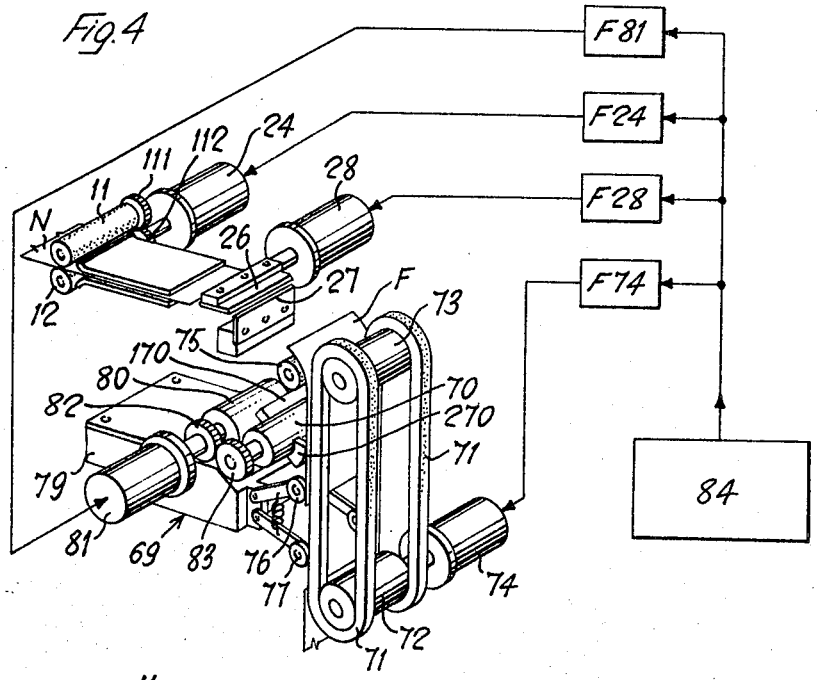
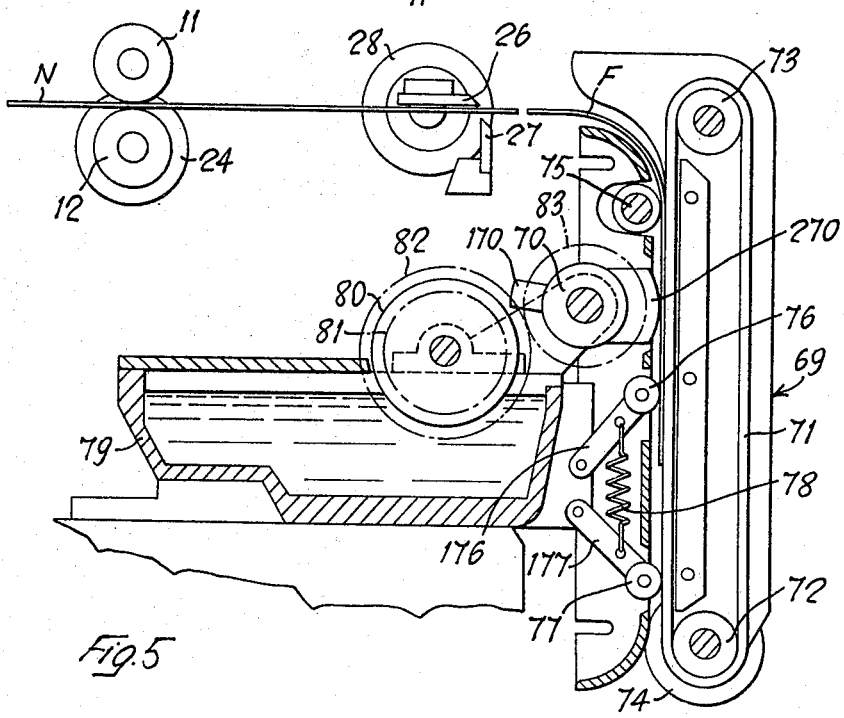
Fig. 5

DEVICE FOR FEEDING SHEETS TO PACKAGING MACHINES

BACKGROUND OF THE INVENTION

The present invention relates to devices for the feeding of sheets of wrapping material to packaging machines, particularly to packaging machines which operate in a non-continuous manner at consecutive cycles and in which the feeding of the sheet is automatically inhibited for every cycle in which the object to be packaged is not present or it is rejected, for example because it has been found defective.

The intermittent motion groups of the sheet feeding devices of the above mentioned type, up to the present date have been mechanically driven by deriving their motion from the packaging machine, for example by means of mechanisms employing Geneva movements or cams, or by means of clutch and brake mechanisms of electromagnetic type, or the like. This type of drive presents the inconvenience that the modification of the length of the sheets requires the modification of a mechanical ratio of a transmission, or of clutch connection and disconnection times. Moreover, whenever the feeding must be inhibited for a cycle of the packaging machine, due to the absence or rejection of an object to be packaged, the mechanical elements for the transmission of the drive from the packaging machine to the intermittent motion group or groups of the sheet feeding device are subjected to sudden and severe stresses at the moment of stopping and at the moment of re-starting the said groups.

When the sheets are obtained by transversal cuttings from a continuous pre-printed web, presently known feeding devices require complex electromagnetic means for maintaining the correct phasing between the printing of the web and the cutting thereof. Of course, the above mentioned inconveniences become greater and more serious, upon increase of the speed of operation of the packaging machine.

SUMMARY OF THE INVENTION

The invention aims to eliminate the above mentioned inconveniences and it has for its object to improve a sheet feeding device of the above described type, in such a manner as to render more simple and less burdensome its operation, to permit an easy and quick modification of the length of the sheets and also to consent an easy and accurate adjustability of the feeding device even and more particularly at very high operational speeds, thus permitting an increase in the operational speed of the associated packaging machine.

According to the invention, at least one intermittent motion group of the feeding device is driven by an independent electric motor, more particularly a stepping motor, controlled, in synchronism with the operative cadence of the packaging machine, by a programmable electronic circuit which can establish for each single motor a well determined law of motion, which can be modified at will.

The invention can be used, for instance, in sheet feeding devices which comprise a roll or bobbin from which a web of wrapping material is unreeled, while the single sheets are cut the one after the other from the said web, with the aid of a group for the intermittent feeding of the web and of a subsequent transversal cutter, for example of the alternating type, downstream of which cutter there can be also provided a glueing device for applying glue onto determined zones of each sheet. In this case, according to the invention, the feeding group, and/or the cutter, and/or the glueing device (if present), are driven each one signularly by an independent electric motor, preferably by a stepping motor, the said motors being controlled by the programmable electronic control circuit.

Preferably, the web of wrapping material is unreeled in a continuous manner from the respective supply roll and it creates, between the said roll and the subsequently arranged intermittent feeding group, at least one loop presenting variable length, which constitutes a buffer storage of the web and permits the combination between a continuous feeding motion upstream and an intermittent feeding motion downstream. In this case, and in combination with the driving of the intermittent feeding group and/or the cutter and/or the glueing device by means of a respective independent electric motor, more particualrly a stepping motor, the web roll also is driven, in the direction of unreeling of the web, by an independent variable speed electric motor. The variable speed motor is controlled by a control circuit comprising means for sensing the operating speed of the packaging machine and means for sensing the peripheral speed of the roll, as well as means for sensing the length of the web loop.

On the other hand, the device can also be adopted in feeding devices of the type above referred to, in which the sheets are not cut from a continuous web, but they are taken singularly the one after the other from a stack of sheets and are caused to pass through a subsequent glueing device.

In this case, according to the invention, the take-up mechanism for taking the sheets from the stack, and the glueing device are driven each by an independent electric motor, preferably a stepping motor, controlled by the programmable electronic control circuit.

The above and other features of the invention and the advantages deriving therefrom will appear evident from the following description of some preferred embodiments, made by way of non-limiting example with reference to the attached sheets of drawings.

BRIEF DESCRIPTION OF THE DRAWINGS

FIG. 4 shows in perspective view a feeding device similar to that of FIG. 1, associated with a subsequent glueing device, with the programmable electronic control circuit for the whole device.

FIG. 5 shows in vertical section and in enlarged scale the glueing device of FIG. 4.

DETAILED DESCRIPTION OF THE PREFERRED EMBODIMENTS

Figure 1:
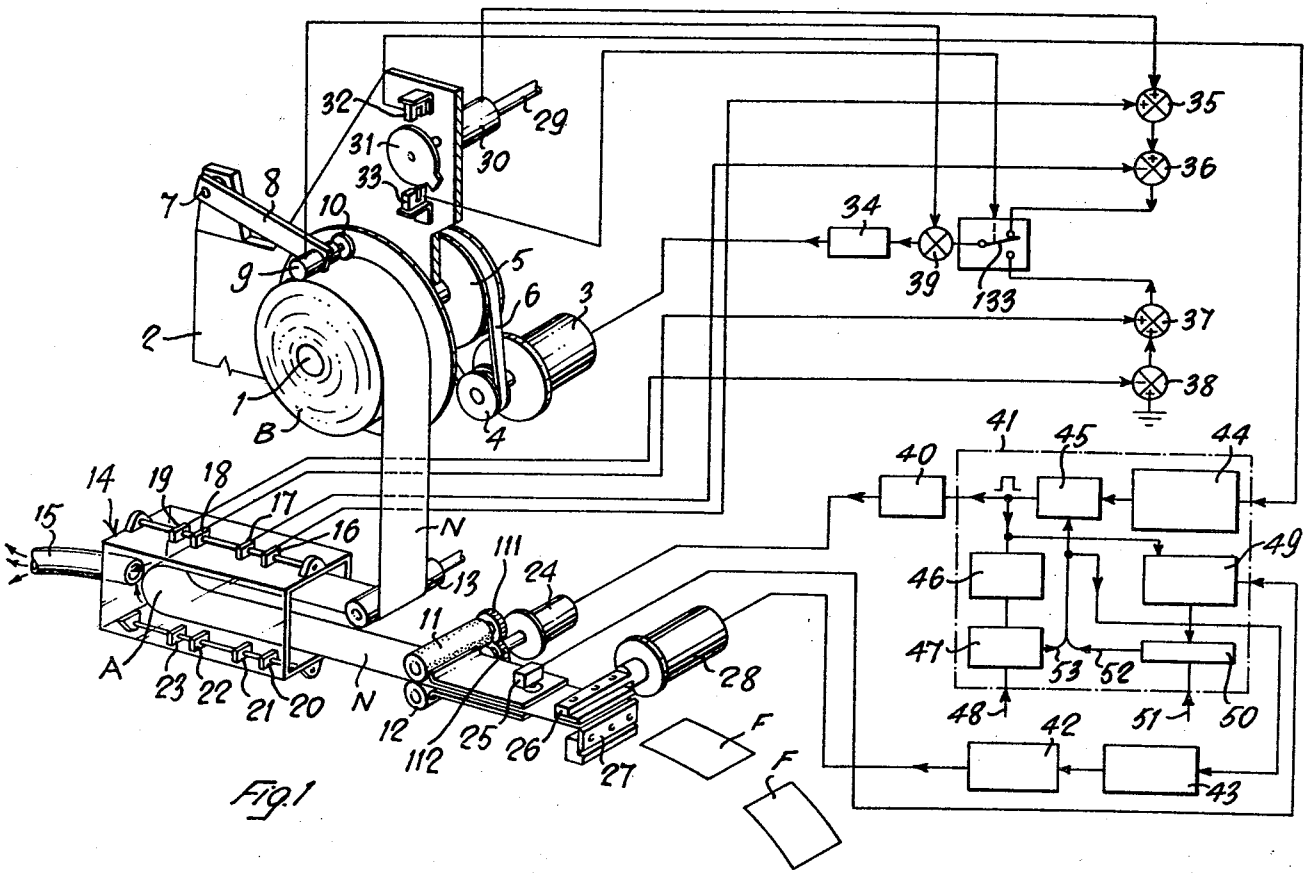
FIG. 1 shows in perspective view a sheet feeding device according to the invention, including the associated programmable electronic control circuit for the individual motors of the various parts of the feeding device.

With reference to FIG. 1, reference letter F indicates equal sized sheets of suitable wrapping material, which must be fed to a subsequent packaging machine (not shown) and which are individually cut in succession from a continuous web N unreeled from a roll B. The roll B is secured to the driving spindle 1 mounted for rotation on the frame 2, and is driven into continuous rotation, in the direction of unreeling of the web N, by an electric motor 3, more particularly a direct current commutator-type motor, through a belt transmission 4, 5, 6. Onto the peripheral surface of the roll B there bears a small rubber-coated roller 10 which is rotatably mounted on an arm 8 swinging around fulcrum 7 and which drives a speedometer dynamo 9.

The web N is unreeled from roll B in a continuous manner but it is fed in an intermittent manner, by means of a pair of feeding rollers 11, 12 to a subsequent transversal cutter consisting of a movable blade 26 and of a fixed counterblade 27. The two intermittent-feeding rollers 11 and 12 are coupled between each other by means of a corresponding pair of gears 111 and 112 and are driven by an independent electric motor 24 of the stepping motor type. The cutting device 26, 27 is of the alternating type, i.e. the movable blade 26 effects at each cutting operation an alternating rotary movement, towards the counterblade 27 and backwards, and it is driven by an independent electric motor 28 of the stepping motor type.

Between the roll B and the intermittent-feeding roller pair 11, 12 the web N coming from the roll is guided around a roller 13 and it forms a buffer loop A at the interior of a box 14, inside which it enters and comes out from the same open head side, or mouth. The opposite head side of the box 14 is connected, by means of a pipe 15 to a pneumatic suction source, so that the loop A formed by the web N at the interior of the box 14 is freely floating and is maintained well tensioned, even when its length varies.

Along the loop A there are provided means for sensing the length of the said loop, consisting of a series of spaced photosensitive elements 16, 17, 18, 19 and by the respective opposite light emitting elements 20, 21, 22, 23. The two photosensitive elements 16 and 17 which are nearer to the open mouth of the chamber 14 serve for determining the minimum and maximum length of the loop A during the normal operation of the packaging machine.

The packaging machine can however perform also one or more idle cycles, during which the feeding of the respective sheet or sheets F is interrupted, whenever there fail to be present the object or objects to be wrapped or packaged, or whenever said objects are determined to be defective. In the latter case the objects are rejected by suitable discarding means of the same packaging machine. Consequently, during the cycles of interruption or inhibition of the feeding of the sheets F to the packaging machine, the length of the loop A increases at the interior of the box 14 and the photosensitive elements 18, 19, arranged in the inner most portion of the box 14 serve for establishing the minimum length of the loop A during the above mentioned cycles of interruption of the feeding.

According to a particular feature of the invention the outlet branch of the loop A which comes out of the box 14 lies in the same traction (pulling) and symmetry plane of the feeding rollers 11, 12. This arrangement permits the elimination of guide rollers for the web N between the outlet of the buffer loop A and the pair of rollers 11, 12 and consequently to avoid the respective friction between the web N and the guide rollers and similar guide surfaces, thus reducing the pulling effort which must be exerted by the feeding rollers 11, 12. Moreover, there is avoided the inertia of any possible intermediate guide rollers between the buffer loop A and the pair of feeding roller 11, 12, which inertia would prevent reaching the desired high feeding speed of the web N towards the cutter.

Downstream with respect to the feeding rollers 11, 12 along the path of the web N, there is suitably arranged an optical sensor 25, for example of the reflection photocell type, for sensing a mark spot provided at predetermined lengths on the web N itself. The said optical sensor 25 is required whenever the web is pre-printed and there exist obvious requirements of phasing between the printing and the cutting of the web into sheets.

Onto the main shaft 29 of the packaging machine, or onto a reference shaft suitably synchronized with the said main shaft, there are mounted a speedometer dynamo 30, whose output signal is proportional to the rotational speed of this shaft, and a cam 31 presenting a lobe which is adapted to cooperate with two detectors 32, 33 which are arranged for instance at diametrally opposite points with respect to the shaft 29, and consist, for example, of two magnetic actuation switches of the type known as "proximity switches". The switch 32 serves for controlling the starting of the feeding rollers 11, 12 at the correct timing, i.e. whenever an object to be wrapped by a sheet F is located in a predetermined position in the packaging machine. The switch 33 serves instead for controlling the starting of the feeding device during a reject or discard phase of a defective object or objects.

The adjustable speed motor 3 which drives the spindle 1 of the roll B, is speed-controlled by a feeder 34, which, in turn, is controlled, alternately and depending upon the operative conditions of the packaging machine, by the outlets of two series of summation circuits 35, 36 and 37, 38, each one of said two series being combined further into a summation circuit 39, which is in series with the contact of the switch 133, actuated by the proximity switch 33 at the control input of the feeder 34. Under normal operating conditions of the packaging machine, in which all the objects fed to the said machine are provided with a wrapper, without any defective objects to be rejected, the switch 133 is closed onto the terminal connected with the series of summation circuits 35, 36. In these conditions, the motor 3 is actuated by a control, which presents as its signal of main prescription, the signal of the speedometer dynamo 30, combined, respectively at 35 and 36, with the signals supplied by the sensors 16 and 17 of minimum and maximum normal length of the loop A of the web. To this signal there is then subtracted, in the summation circuit 39, the feed-back signal which is supplied by the speedometer dynamo 9 and serves for maintaining constant the peripheral unreeling speed of the web N from the roll B, upon decreasing of the diameter of the roll B itself, caused by the said unreeling of the web N. This constancy of the speed of the web N is obtained thanks to the fact that, upon decrease of the diameter of the roll B, also the output feed-back voltage of the speedometer dynamo 9 tends to decrease proportionally, so that the rotational speed of motor 3 increases correspondingly, and consequently also the rotational speed of spindle 1, so as to compensate, at every instant, the reduction of the peripheral speed of the roll B upon decrease of its diameter.

Under normal operating conditions, the length of the buffer loop A of the web N must not go below the minimum limit permitted by the sensor 16 and must not go over the maximum limit permitted by sensor 17. Consequently, in the summation circuit 35, the signal from the minimum length sensor 16 is summed with the main prescription signal supplied by the speedometer dynamo 30, while in the summation circuit 36, the signal from the maximum length sensor 17 is subtracted from the said main prescription signal.

Therefore, for maintaining the web loop A within two predetermined length levels, to the main prescription signal there is summed or subtracted, as the case may be, an appropriate percentage of speed prescription, given by the sensors 16 and 17, so as to accelerate motor 3 in response to sensor 16 and to decelerate same in response to sensor 17.

The interspace between sensors 16 and 17 must be such that they will intervene only for a variation of length of the loop A greater than the length corresponding to a sheet F. In fact, by this arrangement, the speed correction imposed by the composition of the main prescription signal generated by the speedometer dynamo 30 combined with the speed percentage prescription signals supplied by the sensors 16 and 17, does not take place cyclically at every sheet feeding operation, but it intervenes only on the deviations of the average speed. In this manner there is obtained a uniform unreeling of the roll B, during the normal operating conditions of the packaging machine.

When the packaging machine must operate idly during an interval in which there is an absence or a discard of one or more defective objects from the wrapping line, the starting of this interval is given by the switch 133 which switches in the series of summation circuits 37 and 38. With this commutation, the main prescription signal supplied by the speedometer dynamo 30 is changed to a zero volt input into the summation circuit 38. Under these conditions, the motor 3 continues its operation for a short time, so as to cause the extension of the loop A of web N up to the sensors 18 and 19. Thereafter, there intervenes the maximum length sensor 19 and the motor 3 is stopped, so that the web unreeling from roll B is stopped. Thus, under conditions of absence or rejecton of defective objects, the web loop A is caused to assume an extension which is greater than the extension which it has under normal operating conditions. This greater extension of the loop is provided in order to permit, at the re-starting of normal operation of the packaging machine, the gradual acceleration of roll B, till it reaches the normal operating condition speed, while the feed rollers 11, 12 can immediately resume their operation, taking advantages of the greater length of the buffer loop A.

The stepping motor 24 which drives the pair of feeding rollers 11, 12, is fed by a power feeder 40 controlled by the output of a translator unit 41. In a similar manner, the stepping motor 28 which drives the movable blade 26 of the cutter, is fed by a power feeder 42 controlled by the output of a translator unit 43.

More particularly, in the translator unit 41, upon receipt of the cadence or clock signal emitted by the switch 32, the generator 44 generates a voltage signal which represents the speed of motor 24. Said signal is composed of a acceleration section, of a braking section and of a section so-called of "start-stop speed" or of stepping speed. This output signal from generator 44 is applied to the input of a voltage-frequency converter 45, which supplies at its output control pulses which are applied to the power feeder 40, so as to guide the motor 24 in such a manner as to cause it to effect the number of steps which are necessary in order that the rollers 11, 12 cause the advancement beyond the cutter 26, 27 of a section of web of predetermined length, corresponding to that of the sheet F. The speed, the acceleration, the deceleration and the times of the feeding cycle of the web N are those which are electrically predetermined in the generator 44.

For each one of the pulses generated in the converter 45, the motor shaft 24 rotates a step and the frequency of said pulses determines the speed of the motor itself. Moreover, there is a counter 46 of the output pulses from the converter 45. The count effected by counter 46 is compared in a decoder 47, which emits a "stop" signal, at the output 53 and which interrupts the output of pulses from the converter 45 for a predetermined count value. The decoder 47 has a comparison input from a microcomputer which controls and coordinates the system.

The above mentioned "stop" signal for the motor 24 of the feeding rollers 11, 12, is also applied, as a "start" signal, to the input of the translator 43 which controls the power feeder 42 of the motor 28 of the movable blade 26 of the cutter. This motor 28 operates in an analogous manner to the motor 24 of the feeding rollers 11, 12, but with a different number of steps, with different speeds, accelerations and decelerations, and with a cycle which is not simply a forward cycle, but a forward and return cycle, considering the alternate rotary movement of blade 26.

When the web N is pre-printed, in order to obtain the desired synchronism between printing and cutting, the signal from the optical sensor 25 is applied to the "start" input of a counter 49, which counters the steps which are necessary to motor 24 in order to phase the printing with the cutting. The output of counter 49 is compared in a decoder 50 with the input 51 from the microcomputer and from said comparison there derives at the output 52 the "stop" signal for the motor 28, as an alternative to the "stop" signal which is present at the output 53 of the decoder 47 when the web N is not pre-printed. In such a manner, the phasing between the printing and the cutting is obtained without the need of modifying the position of the optical sensor 25 with respect to the members of the packaging machine, upon variation of the distance between the "spot" mark and the cutting line.

In order that the motor 24 of the feeding rollers 11, 12 may stop immediately, without losing the electronic control, it is necessary that said motor finds itself already in the "start-stop" speed, when the "stop" signal arrives. This is obtained by suitably proportioning the acceleration and deceleration sections of the speed signal.

A further feature of the invention has the scope of eliminating the inconvenience of the stumbling of the leading edge of the web N against one of the blades 26, 27 of the cutter at each feeding cycle of the said web N by the feeding rollers 11, 12. The said inconvenience is due to the tendency of the cut edge of the web, upstream of the cutter, to adhere or stick to the blade of the cutter. According to the invention, and in order to obviate to the said inconvenience, as soon as the cutting of the web N has been effected, and during their unoperative phase, feeding rollers 11, 12, are caused to rotate backwards a very small angular fraction in order to detach the web from the blades 26, 27 of the cutter.

The start for the said backward movement of the feeding rollers 11, 12 is derived from the stop signal of the cutting cycle of the cutter motor 28. The said auxiliary backwards rotation cycle of motor 24 is performed with a procedure analogous to that described for the feeding cycle of the sheet F.

The driving of the feeding rollers 11, 12 and of the cutter 26, 27 by means of the individual electric stepping motors 24, 28, controlled by the above described programmable electronic circuit, presents a series of advantages which simplify and accelerate remarkably the operation of the packaging machine.

A first advantage resides in the facility with which the length of the sheets F cut from the web can be varied. In fact, in the case of sheets F to be cut from an unprinted web N, their length depends substantially from the value of the reference count which is loaded through the input 48 into the encoder 47. Encoder 47 compares the count with the count of the control pulses (steps) for the power feeder 40 of the motor 24, which count is effected in the counter 46. When the decoder 47 has reached the parity comparison, it produces a stop signal at output 53 which is coupled to the converter 45 for controlling the motor 24 of the feeding rollers 11, 12. Said signal acts also as activation signal on the translator 43 which controls the power feeder 42 of the cutter motor 28. It is evident that the length of the cut sheet F will depend finally on the reference count which has been loaded from the exterior through the input 48. The exterior can consist of outputs of a microcomputer which controls the whole system of the packaging machine.

Another advantage resides in the in-phase cutting of pre-printed webs, since, upon variation of the length of the sheet F and of the distance between the spot mark on the web and one of the two edges of the sheet, it is not required to vary the position of the optical sensor 25 with respect to the cutting line of the cutter 26, 27. This is possible because the signal from the switch 32 activates the voltage generator 44 which promotes the emission of the step pulses for the feeder 40 of motor 24 by the voltage-frequency converter 45. However, in this instance, the counter 49 begins the count of said pulses just from the moment at which the spot mark on the web N comes to activate the optical sensor 25. The decoder 50 compares the count of the counter 49 with a numerical reference which is applied to the input 51 of the decoder from the outside, for instance from the output of a microcomputer which controls the packaging machine. This numerical reference measures the number of steps by which the web N must be advanced, subsequently to the sensing of the spot on the web, in order to put in phase the printing and the cutting. In other words, at the moment of sensing of the spot on web N, this latter presents ideal separation lines of the sheets. The number of the steps must be such as to bring the ideal line which is nearer to the cutter in correspondence with the cutting line of the said cutter. Thus, when the count of the counter 49 reaches parity with the above mentioned numerical reference, the web N reaches the cutting position with the printing which is in phase with the cutting itself, and the decoder 50 issues on output 52 a stop signal which stops the output of the step pulses of converter 45 and at the same time activates the translator 43 which controls the power feeder 42 of the motor 28 which drives the movable blade 26 of the cutter. In this manner, the motor 24 of the feeding rollers 11, 12 of the web N is caused to start by the clock or consent switch 32, however it is stopped by the output 52 of the decoder 50, in dependence from the spotting of a spot mark on the web N by the optical sensor 25, as well as from the reference number loaded from the outside into the decoder through the input 51. Said reference number will be modified, obviously, depending upon the modification of the length of the sheet F and of the distance between the spot on the web and one of the two edges of the sheet.

There is obtained in this manner the advantage that the phasing between the printing on the web N and the cutting into sheets of the web itself may be changed without changing the position of the optical sensor 25 with respect to the cutting line of the cutter 26, 27.

Figure 2:
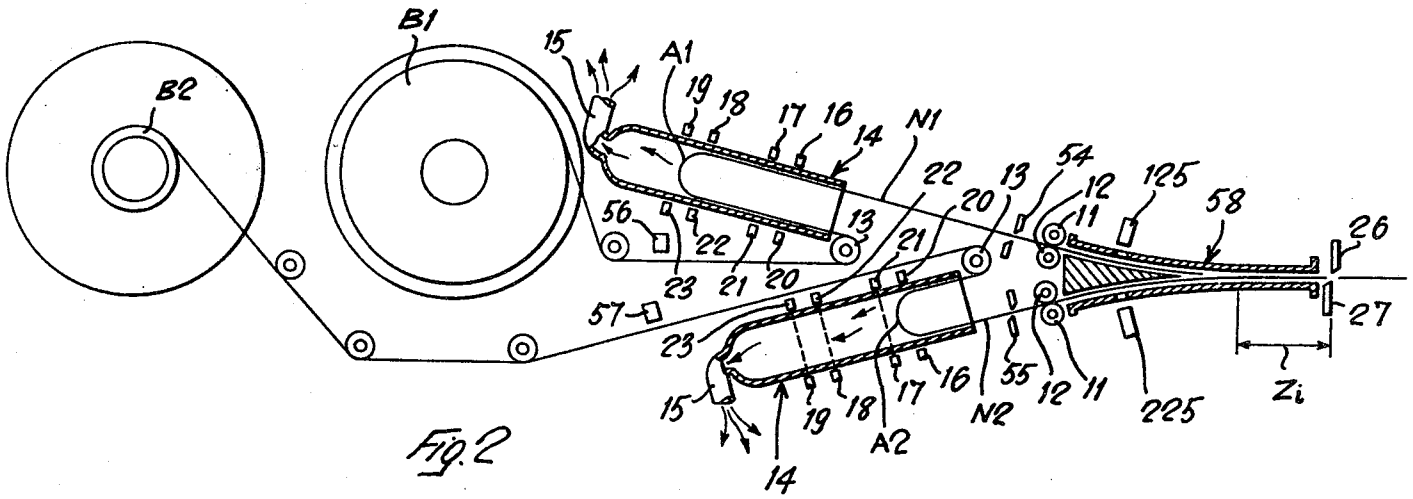
FIG. 2 shows in longitudinal section a pair of feeding devices according to FIG. 1, for the continuous operation with automatic change-over of the roll.

FIG. 2 illustrates a feeding device which is preferably used with the intermittent feeding rollers 11, 12 and the transversal cutter 26, 27. This feeding device presents a high degree of operative adaptability which permits the use of two pairs of feeding rollers 11, 12 in alternate operation in association with a single subsequent cutter 26, 27. This arrangement permits automatic changing of the roll, i.e. of automatically shifting to the feeding of the web N from a reserve roll, whenever the web from the roll being unreeled is almost exhausted.

In FIG. 2 reference characters N1 and N2 indicate two webs of wrapping material being unreeled from a full reserve roll B1 and from a roll B2 almost exhausted. Each web, N1 and N2, forms a respective buffer loop A1 and A2 at the interior of a respective box 14. Each box 14 is provided with sensors 16, 17, 18, 19 sensing the length of the loops A1, A2 cooperating with opposite light emitting means 20, 21, 22, 23. The outgoing sections of the loops A1, A2 converge towards a single transversal cutter 26, 27 and are suitably guided upstream of this cutter, inside a Y-shaped guide 58 presenting converging ducts. Along the path of each web N1, N2 there are provided an optical sensor 125, 225, which senses the presence of the respective web, and a pair of feeding rollers 11, 12, as well as a manually operated cutter 54, 55 for neatly cutting (trimming) the leading end of the web N1 or N2 coming from the reserve roll B1 or B2. Upstream of each buffer loop A1, A2, along the path of each web N1, N2, there is provided a detecting device 56, 57, which indicates the depletion of the respective roll B1, B2 and may consist, for example, of a photosensitive device, of the transparency or reflection type. The cutter 26, 27 and the pairs of feeding rollers 11, 12, are driven in the manner as indicated with reference to FIG. 1.

In the case that the webs N1, N2 are not pre-printed, and that the exhausted roll is roll B2, the shifting of the rolls takes place in the following manner.

The leading end of web N1 of the reserve roll B1 is trimmed with the aid of the manual cutter 54, and it is inserted between the respective rollers pair 11, 12. Subsequently, by depressing a suitable start pushbutton (not illustrated), there is started an anomalous dephasing cycle of the stepping motor 24 driving the said feeding rollers 11 and 12. The flexibility of the electronic control circuit permits the realization of the said anomalous cycle, without the need of mechanical devices. During this cycle, the stepping motor 24 rotates at "start-stop"

speed, as above previously described. Upon sensing the leading edge of the reserve web N1 the detector 125 emits a signal. This signal stops the motor 24 of the respective feeding roller pair 11, 12, after a number of steps such that the leading end of web N1 is brought in proximity to the zone of interference Zi between the two webs N1 and N2, at a determined number "n" of steps from the cutter 26, 27 at the outlet of the Y-shaped web guide 58. The procedure of unreeling of the said anomalous cycle is substantially analogous to that previously described for the phasing of printing and cutting, in the case of pre-printed web.

Upon exhaustion of the roll B2, signalled by the detector 57 and after completion of the cutting cycle of the last sheet F permitted by the buffer web N2 of the respective loop A2, there starts an unoperative interval of the feeding rollers 11, 12 associated with web N2.

During this interval, the stop signal of the cutting cycle of the cutter 26, 27, gives start to an anomalous cycle of motor 24 which controls the feeding rollers 11, 12 associated with web N2. This anomalous cycle consists in a backwards rotation of rollers 11, 12 contrary to the feeding direction of web N2, in such a manner as to withdraw from the cutter 26, 27, the terminal portion of the web N2 of the exhausted roll B2. Simultaneously, or with a suitable time delay, the stepping motor 24 which drives the feeding rollers 11, 12 associated with reserve web N1, starts another anomalous cycle which brings the leading end of the web N1 in correspondence with the cutting line of the cutter 26, 27, thus causing it to advance the above mentioned number of "n" steps. In this manner, when the next start signal arrives, the reserve web N1 is in condition to be normally fed.

In the case that the web of rolls B1, B2 is previously printed, the trimming operation of the leading edge of the reserve roll web N1 must be effected on the predetermined cutting line. Thereafter, said leading edge is inserted between the respective feeding rollers 11, 12 and the web is advanced manually in such a manner that the trimmed leading edge passes beyond the detector 125 which will be of the "spot" reading type. By depressing the actuation pushbutton, there is started an anomalous cycle of the stepping motor 24 which drives the pair of feeding rollers 11, 12 associated with the web N1 of the reserve roll B1. This cycle is effected at "start-stop" speed, in such a manner that, after the sensing of the reference spot on the web by the optical sensor 125, the said stepping motor 24 performs a number of steps so as to bring the trimmed leading edge of the reserve web N1 in proximity of the zone of interference Zi, at a number "n" of steps from the cutting line of the cutter 26, 27. The operation is then completed as in the case of the unprinted web.

The above mentioned system of changing the rolls prevents portions of discarded web to go downstream of the cutter 26, 27 and presents the further advantage of obviating the inconveniences which can take place in proximity of the cutter, in the zone of interference of the two webs, due to an inaccurate positioning of the leading end of the web of the reserve roll.

Figure 3:
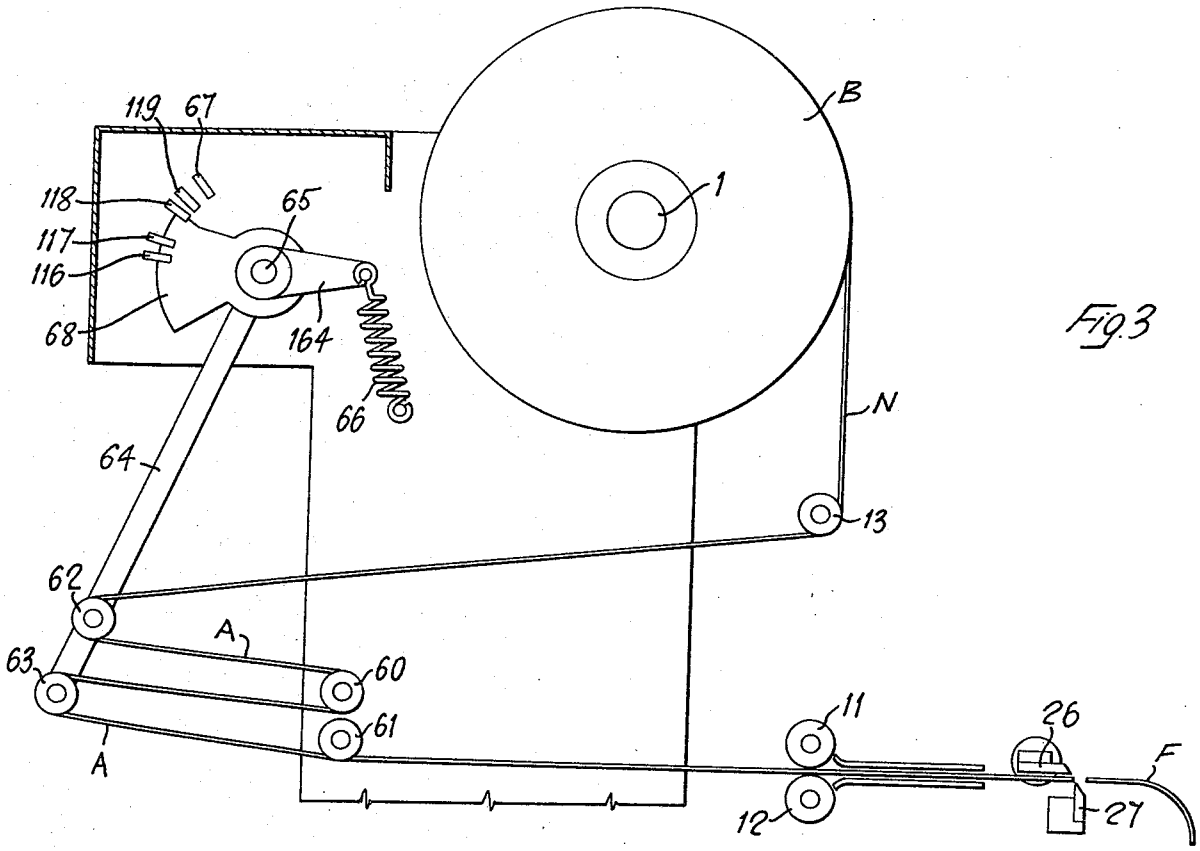
FIG. 3 shows in elevation a modified embodiment of the feeding device according to FIG. 1.

When the unreeling speeds of web N from roll B are not too high, and allow the pulling action exerted by the pair of feeding rollers 11, 12 to overcome the inertia of the guide rollers one or more buffer loops obtained mechanically may be used as shown in FIG. 3, instead of the buffer loop shown in FIG. 1 which is freely floating in the air at the interior of suction box 14. Referring to FIG. 3, the web N unreeled from the roll B is guided over the roller 13 and forms one or more buffer loops A by means of two fixed guide rollers 60, 61 and two movable guide rollers 62, 63 which are freely rotatable and mounted on a lever 64 which is capable of swinging around axis 65. The swinging lever 64 is subjected to the action of a traction spring 66 which acts on an appendage 164 of the lever 64, and tends to lengthen the loops A. The photosensitive detectors 16, 17, 18, 19 described in connection with the embodiments of FIG. 1, are substituted with a series of magnetic actuation switches (proximity switches) 116, 117, 118, 119, actuated by a sector 68 integral with the swinging lever 64 and coaxial to the axis 65. The series of proximity switches comprises also a fifth switch 67 which is actuated only in case of breaking of the web N, and starts the operation of changing of the roll, when the lever 64 effects its maximum angular excursion under the action of spring 66.

Figure 6:
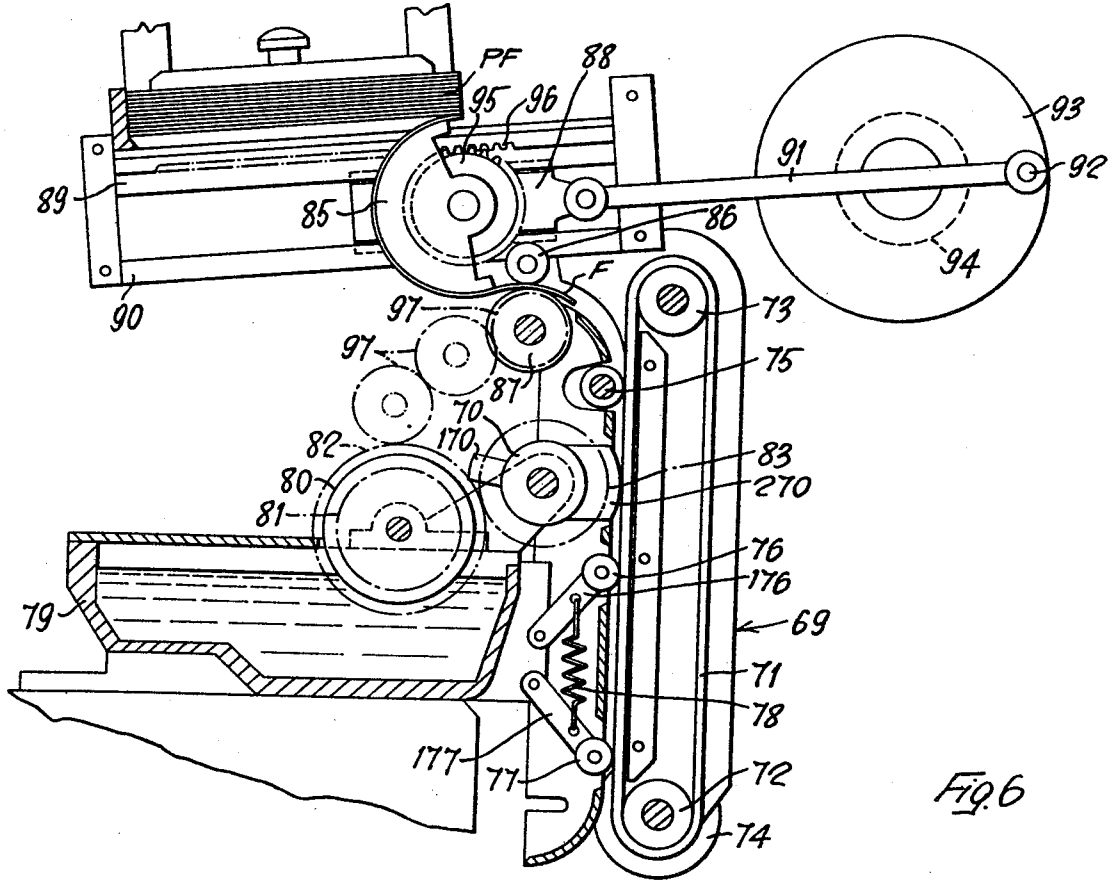
FIG. 6 shows in side elevation another embodiment of the feeding device according to the invention, in which the sheets are taken from a stack of sheets and are caused to pass through a subsequent glueing device.

The sheets F of wrapping material, cut from the web N, may be fed directly to the packaging machine or they can be previously provided with a glueing agent on one or more predetermined zones of their surface. In this latter case, downstream of the cutter 26, 27 of the feeder device according to FIGS. 1 to 3, there is provided a glueing device which is shown in FIGS. 4 to 6 and indicated by reference numeral 69 as a whole. The said glueing device 69 comprises conveying means which cause the sheets F supplied by the cutter 26, 27 to pass before a glueing roller 70 provided with projecting portions 170, 270 for applying the glue. The conveying means consist of at least two parallel endless belts 71, interspaced between one another and guided around two guide rollers 72, 73, of which one (in the case as shown roller 72) is driven by an independent electric motor 74 of the stepping motor type.

Pressure rollers 75, 76 and 77 cooperate with the said belts 71, elastically urged towards the said belts, as shown in detail in FIGS. 5 and 6 for the pressure rollers 76, 77. In fact, the said pressure rollers 76, 77 are mounted on swinging arms 176, 177 which diverge and are inclined in opposite directions with respect to the conveying plane of the belts 71. A traction spring connects the two swinging arms 176, 177 and tends to bring them closer to each other, thus pressing the respective pressure rollers 76, 77 against the corresponding endless belt 71. The glueing device 69 comprises moreover a small basin or tray 79 filled with glue, inside which there dips a dip-roller 80 which transfers the glue to the projecting glue-applying elements 170, 270 of the glueing roller 70. The dip-roller 80 is driven by an independent electric motor 81 of the stepping motor type.

The movement of the glueing roller 70 is derived from the dip-roller 80 by means of a pair of gears 82, 83.

When the movable blade 26 of the cutter effects the cutting of a sheet F from the web N, the leading end of said sheet F is already engaged by the conveying means of the glueing device 69, i.e. it is nipped between the belts 71 and the first pressure rollers 75. The belts 71 are driven by the stepping motor 74 in the same manner as the stepping motor 24 drives the feeding rollers 11, 12, thus conveying each sheet F through the glueing apparatus 69 with the same law of motion which regulates the feeding of the web N. In this manner there are avoided the stumbling of the leading edge of the web, and the wrinkling or stretching of the said web N. The stepping motor 81 drives the glueing roller 70 through the dip-roller 80 and in phase with the conveying of the sheet F, in such a manner that the projecting elements 170, 270 may apply the glue onto the prescribed zones of the sheet F carried by belts 71. Also the glueing roller 70 is driven by motor 81 with the same law of motion by which motor 24 regulates the advancement of the web N. In this manner there are avoided the stumbling, wrinkling or stretching of the sheet F. In the case that the feeding is interrupted due to lack or rejection of the object to be packaged, there takes place the stopping of the motors 24 and 28 of the feeding rollers 11, 12 and of the cutter 26, 27, and the motors 74, 81 of the conveying belts 71 and of the glueing rollers 70.

In the feeding device according to FIGS. 4 and 5, each one of the individual stepping motors 24, 28, 74 and 81 is fed by a respective power feeder F24, F28, F74 and F81 and the said power feeders are controlled by a microcomputer 84. Each power feeder F24, F28, F74 and F81 causes the rotation of the respective motor 24, 28, 74 and 81 of a step or fraction of a step at each cadence (clock) pulse which receives at its input from the microcomputer 84. The microcomputer 84 applies to the inputs of the power feeders F24, F28, F74 and F81, besides the said clock pulse, also other control signals relating for example to the direction of rotation, to the inhibition, to the intensity of current and to other service parameters. Therefore, by varying the clock pulse and the signals relating to the direction of rotation and the other parameters of service, the microcomputer 84 controls, through the power feeders, the complete law of motion (angle and direction of rotation, speed, angular acceleration and deceleration) of each stepping motor 24, 28, 74 and 81, and it may determine for each one of these motors any whatsoever law of motion. More particularly, the laws of motion of the motors 24, 28, 74, 81 may be identical for two or more different motors, as previously indicated, or they may be identical only for those angular fractions of two or more different motors, in which the elements controlled by the said motors engage the same sheet F, as in the case of the motors 74 and 81 which drive the conveying belts 71 and the glueing roller 70.

In FIG. 6 there is shown another embodiment of the sheet feeding device according to the invention, in combination with a glueing device 69 which is identical with the one described and illustrated with reference to FIGS. 4 and 5.

According to this embodiment, the sheets F of wrapping material, instead of being cut from a continous web, are taken one after the other by means of a take-up suction sector 85 from the bottom or base of a stack PF of already cut sheets, and are fed by means of a pair of feeding rollers 86, 87 to the belts 71 and the respective pressure rollers 75, 76, 77 of the glueing device 69. The take-up sector 85 is rotatably mounted on a slide 88 which is slidably guided on rectilinear guides 89, 90 parallel to the plane of the base of the stack PF of sheets, and it is alternately moved along said guides by means of a connecting rod 91 hinged to the crank pin 92 of a crank disc 93. The crank disc 93 is driven by an independent motor 94 of the stepping motor type. The take-up suction sector 85 is integral with a toothed wheel 95 which meshes with a fixed rack 96 extending along the guides 89, 90. Consequently, the take-up sector 85 effects a rolling movement resulting from the translatory rectilinear movement of the slide 88 and from the rolling of the toothed wheel 95 onto the fixed rack 96. The take-up suction sector 85 is connected to the suction source in a known manner, for example through its shaft.

The pair of conveying rollers 86, 87 is driven, through a gear train 97, by the stepping motor 81 associated with the dip roller 80 of the glueing device 69.

Both the motor 94 of the take-up sector 85 and the motor 81 which drives, through the dip-roller 80, the glue-applying roller 70 and the pair of conveying rollers 86, 87, as well as the motor 74 which drives the belts 71, are controlled, as described in connection with the embodiment of FIG. 4. Each motor is controlled through an associated power feeder by a microcomputer which determines such a law of motion as to coordinate the taking of the sheet F from the stack PF and its subsequent passage through the glueing device 69 with the application of the glue onto the desired zones, avoiding also the stumbling of the leading edge of the sheet F at the inlet section between the motorized conveying rollers 86, 87.

One of the advantages obtained by the embodiment according to FIG. 6, and particularly by the adoption of independent motors 74, 81, 93, consists in the fact that whenever the object to be packaged is not present or it must be discarded because it is defective, and therefore whenever there must be inhibited the taking of the sheet F from the stack PF, it is not necessary to intercept the suction of the take-up sector 85, but it is sufficient to stop the motion of the said sector, by stopping its driving motor 94. The stopping of the driving motor is more advantageous than the interruption of the suction, particularly when the rate of taking of sheets F from the stack PF is high. In fact, the interruption of the suction presents the inconvenience that upon re-starting of the operation, the intensity of the suction is relatively low, since the various ducts which connect the take-up sector 85 to the suction source cannot be emptied in a very quick manner of the atmospheric air.

Another modification of the sheet feeding device according to the invention relates to the glueing device 69. Instead of being of the type presenting a tray 79 with dip-roller 80 and glue-applying roller 70, glueing device 69 may consist of a nozzle glueing device, presenting nozzles arranged in such a manner as to apply the glue in the desired zones of the sheet F. In this latter case, the nozzles are actuated by an associated independent electric motor, controlled, in an analogous manner to the other single motors of the feeding device according to the invention, during the stationary phase of the sheet F.

In view of the above it is evident that the invention is not limited to the above shown and described embodiments, but it can be broadly varied and modified, particularly in the construction, without departing from the inventive principle as above described and claimed hereafter.

We claim:

1. A device for feeding sheets of wrapping material cut from a roll formed of wrapping material web to a cyclically operating packaging machine which is subject to periods of interruption, said device comprising;

a transversal cutter for cutting single sheets of wrapping material from the web;

at least one intermittent feeding group for feeding the web to said cutter;

an independent electric stepping motor for driving said at least one feeding group;

a programmable electronic control circuit for controlling said stepping motor to drive said at least one feeding group in accordance with a predetermined sequence of motions in synchronism with the cyclical operation of the packaging machine;

an independent variable-speed electric motor for driving the roll to unreel the web;

a web buffer storage means disposed between the roll and said at least one feeding group for creating a variable length loop in the web as it is unreeled from the roll; and a control circuit for controlling said variable-speed motor, said control circuit including a first means for producing a first control signal which is fed to said variable-speed motor for controlling the speed thereof to maintain the length of said loop between a first and a second length, a second means for producing a second control signal which is fed to said variable-speed motor for controlling the speed thereof to maintain the length of said loop between a third and a fourth length, and switch means for coupling said first control signal to said variable speed motor when the packaging machine is cyclically operating and for coupling said second control signal to said variable speed motor when the cyclical operation of the packaging machine is interrupted.

2. A device according to claim 1 wherein said first control means includes first and second detector means each for producing a respective one of first and second input signals when said loop reaches a respective one of the first and second lengths, and first combining means for combining said first and second input signals to form said first control signal; and said second control means includes third and fourth detector means each for producing a respective one of third and fourth input signals when said loop reaches a respective one of the third an fourth lengths, and second combining means for combining said third and fourth input signals to form said second control signal.

3. A device according to claim 1 wherein said predetermined motions include momentarily driving said at least one feeding group backwards to withdraw and detach the leading edge of the web from said cutter.

4. A device according to claim 1 further comprising a glueing device for receiving single sheets of wrapping material from said cutter and applying glue on at least one predetermined zone of each of the sheets.

5. A device according to claim 4 further comprising second and third independent stepping motors for controlling said cutter and said glueing device, respectively, said first, second and third stepping motors each being controlled by said programmable control circuit.

6. A device according to claim 1 or 5 wherein said at least one feeding group comprises a pair of feeding rollers each provided with corresponding gears for coupling the movement of said rollers.

7. A device according to claim 1 or 5 wherein said cutter comprises a fixed blade and a movable blade, said movable blade having a rotary alternating motion and cooperating with said fixed blade for cutting the web.

8. A device according to claim 1, wherein said first means of said control circuit includes a speedometer dynamo connected to a shaft of the packaging machine for producing a first input signal indicative of the operational speed of the packaging machine;

means for producing second and third input signals indicative of said first and second lengths, respectively, of the web loop; and means for combining said first, second and third input signals to produce said first control signal;

said second means of said control circuit includes means for producing fourth and fifth input signals indicative of said third and fourth lengths, respectively, of the web loop; and means for combining said fourth and fifth input signals to produce said second control signal; and said control circuit further includes means for producing a sixth input signal indicative of the peripheral speed of the roll; and means for combining said sixth input signal with a respective one of said first and second control signals.

9. A device according to claim 8 further comprising a glueing device for receiving single sheets of wrapping material from said cutter and applying glue on at least one predetermined zone on each of the sheets.

10. A device according to claim 9 further comprising second and third independent electric stepping motors for controlling said cutter and said glueing device, respectively, said first, second and third stepping motors each being controlled by said programmable control circuit.

11. A device according to claim 8 or 10 wherein said means for producing said sixth input signal indicative of the peripheral speed of the roll comprises a rubber coated roller which is pressed against the peripheral surface of the roll.

12. A device according to claim 1 wherein said web storage means includes a swinging lever and at least one tension roller mounted on said lever, said web passing around said tension roller to form said loop; and said control circuit further includes means for producing input signals indicative of the length of the web loop including a series of magnetic switches and an element integral with said lever for actuating said magnetic switches; and means for combining said input signals for producing said first and second control signals.

13. A device according to claim 12 further comprising a glueing device for receiving single sheets of wrapping material from said cutter and applying glue on at least one predetermined zone of each of the sheets.

14. A device according to claim 13 further comprising second and third independent electric stepping motors for controlling said cutter and said glueing device, respectively, said first, second and third stepping motors each being controlled by said programmable control circuit.

15. A device according to claim 12 wherein said series of magnetic switches comprises a first pair of magnetic switches for producing input signals which are respectively indicative of the minimum and maximum length of the loop during cyclical operation of the packaging machine, said first means including means for combining the input signals from said first pair of magnetic switches for producing said first control signal; and a second pair of magnetic switches for producing input signals which are respectively indicative of the minimum and maximum length of the loop during periods of interruption of the cyclical operation of the packaging machine, said control means including means combining the input signals from said second pair of magnetic switches for producing said second control signal.

16. A device according to claim 13 wherein said control circuit further includes means for producing a first speed signal indicative of the operational speed of the packaging machine; means for producing a second speed signal indicative of the peripheral speed of the roll; means for combining said first and second speed signals with the input signals produced by said first pair of magnetic switches for producing said first control signal and means for combining said second speed signal with the input signals produced by said second pair of magnetic switches for producing said second control signal.

17. A device for feeding sheets of wrapping material cut from first and second alternately operative rolls, each roll formed of a respective one of first and second wrapping material webs, to a cyclically operating packaging machine, wherein the roll other than the operative roll is held in reserve until the operative roll is exhausted and then automatically becomes the operative roll, each of the first and second webs having a leading end and each of the webs traversing a path within said device, said device comprising:

a single transversal cutter for cutting single sheets of wrapping material web from the operative roll;

first and second intermittent feeding groups each for feeding web from a respective one of the first and second rolls to said single cutter;

first and second independent electric stepping motors each for driving a respective one of said first and second feeding groups, and a third independent electric stepping motor for driving said single cutter;

first and second loop formation means each disposed for forming at least one web loop between a respective one of the first and second rolls and a respective one of said first and second feeding groups;

first and second detector means each disposed along the path of a respective one of the first and second webs prior to a respective one of said first and second loop formation means for producing first and second depletion signals indicating the exhaustion of a respective one of the first and second rolls;

first and second manually operated cutters each disposed along the path of a respective one of the first and second webs subsequent to a respective one of said first and second loop formation means for trimming the leading end of a respective one of the first and second of webs;

guide means including first and second paths each converging from a respective one of said first and second feeding groups in the direction of said single cutter for guiding a respective one of the first and second webs to said single cutter;

a programmable electronic control circuit for controlling each of said stepping motors for operating in accordance with respective predetermined sequences of motion in synchronism with the cyclical operation of the packaging machine, said programmable electronic control circuit being responsive to the depletion signal from one of said first and second detector means indicating that the web from the operative roll has become exhausted for causing the feeding group associated with the web from the exhausted roll to be driven in a backward direction to withdraw from said single cutter the terminal portion of the web from the exhausted roll and for promoting the advancement of the leading end of the web from the reserve roll up to the cutting line of said single cutter.

18. A device according to claim 17 further comprising:

independent variable-speed electric motor means for driving the operative roll to unreel; and a control circuit means for controlling said variable-speed motor including:

means for producing a first signal indicative of the operational speed of said packaging machine;

means for producing a second signal indicative of the peripheral speed of the operative roll;

means for producing a third signal indicative of the length of said web loop associated with the operative roll; and means combining said first, second and third signals for producing a control signal which is fed to said variable-speed motor.

19. A device according to claim 18 further comprising a glueing device for receiving single sheets of wrapping material from said single cutter and applying glue on at least one predetermined zone of each of the sheets.

20. A device according to claim 19 further comprising a fourth independent electric stepping motor for controlling said glueing device, said fourth stepping motor also being controlled by said programmable control circuit.

21. A device according to claim 17 or 20 further comprising first and second presence detector means each disposed between a respective one of said first and second feeding groups and said single cutter for detecting the presence of the respective webs.

22. A device for feeding sheets of wrapping material cut from a roll formed of wrapping material web to a cyclically operating packaging machine, said device comprising:

a tranversal cutter for cutting single sheets of wrapping material from the web;

at least one intermittent motion feeding group for feeding the web to said cutter;

a first independent electric stepping motor for driving said at least one feeding group;

a programmable electronic control circuit for controlling said first stepping motor to drive said feeding group in accordance with a predetermined sequence of motions in synchronism with the cyclical operation of the packaging machine;

means for receiving the cut sheets from said cutter and forming a stack of the sheets, said means having a base supporting the bottom of the stack of sheets;

a glueing device for receiving sheets from the stack of sheets and applying glue thereto;

a take-up suction sector for taking one after the other of the sheets from the bottom of the stack of sheets and passing them to said glueing device;

a coaxial toothed wheel integral with said take-up suction sector;

rectilinear slide guides parallel to said base;

a slide movable back and forth on said slide guides, said take-up suction sector being rotably mounted on said slide;

a fixed rack parallel to said slide guide;

a crank mechanism; and an electric crank motor for deiving said slide via said crank mechanism whereby said coaxial toothed wheel integral with said take-up suction sector engages said fixed rack.

23. A device according to claim 22 further comprising at least one other independent electric stepping motor controlled by said programmable electronic control circuit for driving said take-up suction section and said glueing device.

24. A device according to claim 22 further comprising:

separate and independent electric motors each for driving a respective one of said take-up suction sector and said glueing device, said separate and independent electric motors being controlled by said programmable electronic control circuit;

a pair of feeding rollers arranged at the input of said glueing device; and a transmission means via which said pair of feeding rollers are driven from one of said separate and independent electric motors.

* * * * *